US007537090B2

(12) United States Patent
Väntänen

(10) Patent No.: US 7,537,090 B2
(45) Date of Patent: May 26, 2009

(54) METHOD AND APPLIANCE FOR TRIPPING THE SAFETY GEAR OF AN ELEVATOR USING AN OVERSPEED GOVERNOR

(75) Inventor: Teuvo Väntänen, Hyvinkää (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 12/000,647

(22) Filed: Dec. 14, 2007

(65) Prior Publication Data

US 2008/0149431 A1 Jun. 26, 2008

Related U.S. Application Data

(63) Continuation of application No. PCT/FI2006/000221, filed on Jun. 21, 2006.

(30) Foreign Application Priority Data

Jun. 23, 2005 (FI) ..... 20050680

(51) Int. Cl.
*B66B 5/06* (2006.01)

(52) U.S. Cl. ..... 187/286; 187/373

(58) Field of Classification Search ..... 187/350, 187/354, 287, 373, 280, 286, 301, 305, 394, 187/399, 355, 359
See application file for complete search history.

(56) References Cited

U.S. PATENT DOCUMENTS 4,653,612 A 3/1987 Winkler
5,226,508 A * 7/1993 Ericson et al. ..... 187/254
5,321,216 A * 6/1994 Jamieson et al. ..... 187/280
5,617,933 A * 4/1997 Ericson ..... 187/350
5,630,483 A * 5/1997 Karner ..... 187/350
7,137,484 B2 * 11/2006 Martin ..... 187/354

FOREIGN PATENT DOCUMENTS

| | | |
|---|---|---|
| DE | 3504264 | 8/1985 |
| EP | 0628510 | 12/1994 |
| EP | 0662444 | 7/1995 |
| FI | 76049 | 5/1988 |

OTHER PUBLICATIONS

Search Report dated Feb. 20, 2006 for corresponding Finnish Application No. FI20050680.

* cited by examiner

*Primary Examiner*—Jonathan Salata
(74) *Attorney, Agent, or Firm*—Harness, Dickey & Pierce, P.L.C.

(57) ABSTRACT

A method for tripping safety gear of an elevator, at a speed lower than a gripping speed of the elevator may include: slowing a rope sheave of an overspeed governor of the elevator using a device adapted to slow the rope sheave; disconnecting an actuator connected to the overspeed governor from movement of the rope sheave when the device slows the rope sheave; and tripping the safety gear in an overspeed situation using a rope driving the overspeed governor via the rope sheave. An appliance for tripping safety gear of an elevator may include: an overspeed governor; a rope sheave of the overspeed governor; a device adapted to slow the rope sheave; and an actuator connected to the overspeed governor that is arranged to disconnect from movement of the rope sheave when the device adapted to slow the rope sheave acts to slow the movement of the rope sheave.

15 Claims, 2 Drawing Sheets

Figure 1:
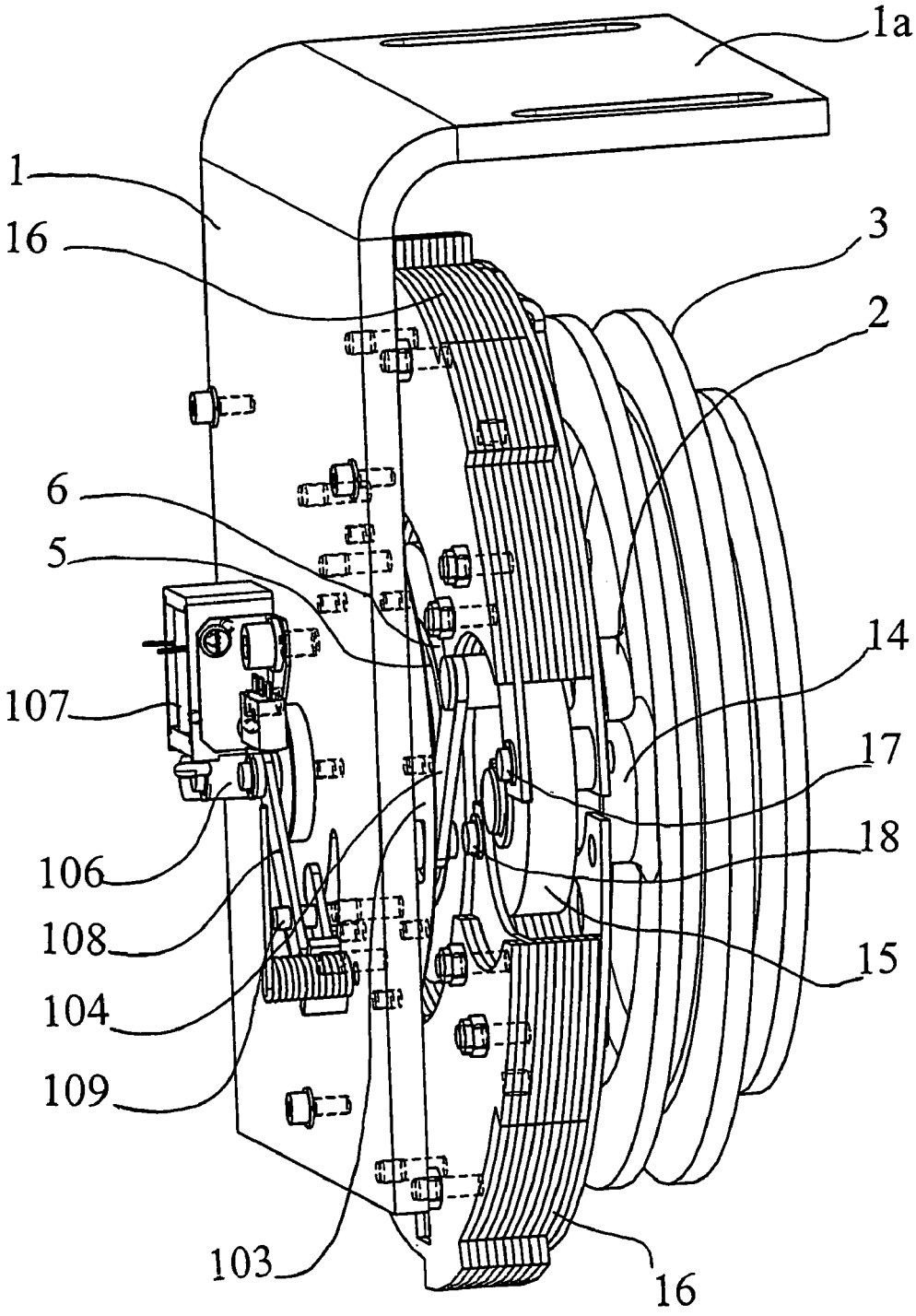

METHOD AND APPLIANCE FOR TRIPPING THE SAFETY GEAR OF AN ELEVATOR USING AN OVERSPEED GOVERNOR

This application is a continuation of PCT/FI2006/000221 filed on Jun. 21, 2006, which is an international application claiming priority from FI 20050680 filed Jun. 23, 2005, the entire contents of which are hereby incorporated by reference.

The present invention relates to a method for tripping safety gear of an elevator and an appliance for tripping the safety gear at a speed lower than the gripping speed of the elevator, in an elevator in which the tripping of the safety gear in an overspeed situation is arranged to occur by means of the rope driving the overspeed governor via a rope sheave. A particular object of the present invention is to achieve gripping when the elevator leaves the floor level in an unintended movement.

Conventionally elevators are equipped with a safety gear, the tripping of which occurs from the triggering of the overspeed governor. A common solution is that when the speed of the elevator rises to the limit value pre-set in the overspeed governor, the overspeed governor trips the safety gear through the same rope as the rope via which the overspeed governor monitors the speed of the elevator. One structure and operation of this type of overspeed governor is described in the Finnish patent specification No. 76049.

In addition to the elevator gripping in an overspeed situation, there are situations in which the safety gear should be made to operate even if the speed of the elevator does not exceed the permitted speed. These situations include, among others, testing the safety gear in conjunction with an inspection of the elevator. There are also possible hazardous situations, in which it should be possible to stop the elevator independently of the hoisting machinery and the operating brake. One such situation, among others, is the elevator starting to move from the floor level with the doors partly or fully open. There is also a need to prevent the elevator moving away from the floor level unintentionally. Often the movement is creeping of the elevator car e.g. in connection with loading. Locking devices are available for some overspeed governors, with which a function to prevent creeping can be handled. In these types of overspeed governors however it is not possible to adjust or set the permitted length of the unintended movement, in which case the function can be too sensitive or insensitive. The length of the creeping distance can vary considerably, thus a safe function is not necessarily achieved without other procedures administered to the elevator. In prior-art solutions it is necessary to take very large forces on the creep monitoring appliances themselves, in which case the solutions become expensive by necessity and can be prone to malfunction.

For the need presented above and as a solution to the problems presented, a method and an appliance are presented as an invention. The method for tripping safety gear of an elevator and the appliance for tripping the safe gear are discussed below. Some embodiments of the invention are characterized by what is disclosed in the claims. Some inventive embodiments are also discussed in the descriptive section of the present application. The inventive content of the application can also be defined differently than in the claims presented below. The inventive content may also consist of several separate inventions, especially if the invention is considered in the light of explicit or implicit sub-tasks or from the point of view of advantages or categories of advantages achieved. In this case, some of the attributes contained in the claims below may be superfluous from the point of view of separate inventive concepts. The features and details of the various embodiments and examples of the invention presented can also be used in conjunction with each other.

The invention can also be described such that with a lightweight or lightweight-structured actuator, through the operation of which the largest permitted unintended movement of the elevator car is at least partly resolved, the activation of the operation of the safety gear of the elevator is achieved in the overspeed governor of the elevator. Preferably the activation occurs in such a way that the actuator itself does not receive or receives only to a limited extent the forces prevailing in the overspeed governor needed to start the gripping or consequent to the state of motion of the elevator car.

The invention can be implemented e.g. such that for tripping the safety gear at a speed lower than the gripping speed of the elevator, connection of the brake, or other device that slows the rope sheave, to the rope sheave is controlled using an actuator, which disconnects from the movement of the rope sheave when the brake or other device that slows the rope sheave connects to brake the movement of the rope sheave. Preferably tripping of the safety gear is caused when the elevator car starts moving from stops. Disconnection of the actuator from the movement of the rope sheave can be effected with a separate force means, e.g. with a spring, and using the rotational movement of the overspeed governor as an aid. To allow a small movement of the elevator car and to avoid needless grippings it is worth setting a distance, e.g. by means of the internal structure of the overspeed governor or otherwise, said distance determining the free rotation of the overspeed governor or the start of braking as from when the overspeed governor begins to rotate as a result of an unintended start of a movement of the elevator car.

With the invention the following advantages are achieved, among others:

- with the invention the tripping of gripping is achieved easily and reliably at a speed lower than gripping speed, e.g. when the elevator leaves the floor level with the doors open.
- the invention can be used to prevent creeping of the car from the landing. By means of the invention the gripping function can be used to replace the leak detent of hydraulic elevators or to achieve a corresponding function in an elevator without counterweight.
- implementation of the invention is simple and does not require large modifications to the basic structure of the overspeed governor.
- the invention is suited to an overspeed governor, which locks in the triggering position and the locking of which is only released when it is rotated backwards; i.e. the invention does not require separate tuning of the overspeed governor or its tripping, but returns at the same time as the elevator is released from the gripping state.
- the solution according to the invention is tolerant to the normal dimension variations that appear in manufacturing, and does not require greater than normal precision in installation work or servicing work.
- in the solution according to the invention the acting bodies of the appliance only receive relatively small forces and therefore they can be designed to be lightweight, inexpensive and reliable
- owing to the invention the force used for tripping of the overspeed governor can be adjusted
- the invention is suited for use in many different types of overspeed governor and is applicable in elevators in which gripping is in only one direction as well as in elevators in which gripping is in both directions the appliance according to the invention can be used for remote tripping at normal speed e.g. in those situations when proper functioning of the overspeed governor must be verified by testing by modifying the structure of the invention with a small modification, e.g. by modifying the shape of the groove, gripping is achieved that is always of the fail-safe type or gripping does not occur at all when the force-limiter spring or control spring breaks.

In the following, the invention will be described in more detail by the aid of an example of one embodiment that as such does not limit the invention. The embodiment in the example of the application of the invention is described in connection with an overspeed governor of the type presented in Finnish patent specification No. 76049.

In the following reference is made to the attached drawings, wherein

Figure 2:
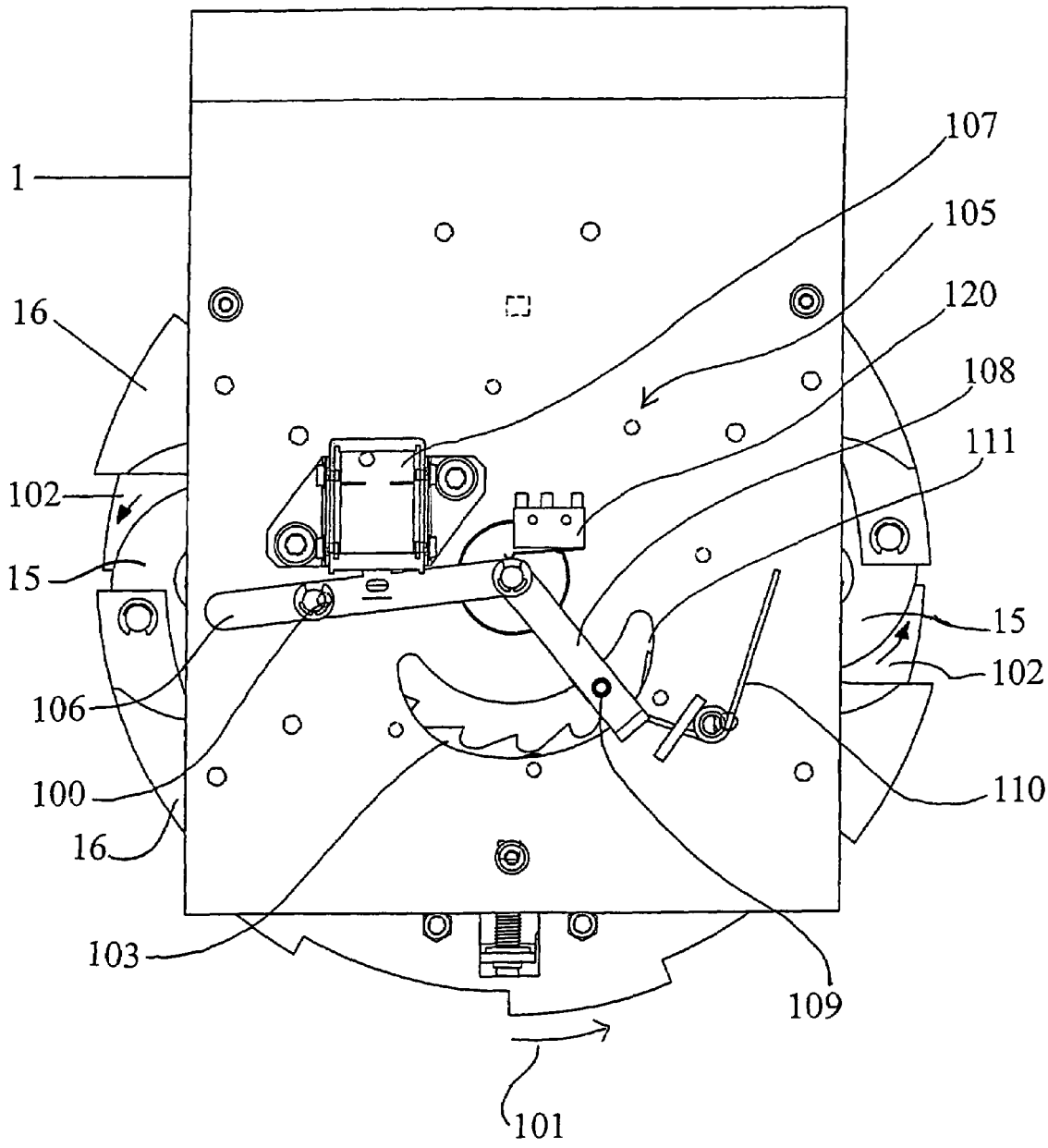

FIG. 1 presents an overspeed governor, in which the invention is applied,

FIG. 2 presents an overspeed governor viewed from the side of the mounting.

The overspeed governor is suspended from the supporting structure by means of the mounting 1. In FIG. 1 the mounting is suspended in which case the fixing point la to the bearing structure is on the top part of the mounting. The fixing point to the bearing structure can be formed otherwise, e.g. on the bottom part of the mounting. On mounting 1 is a fixed axle 2, on which is a bearing-mounted, freely-turning rope sheave 3 mounted via ball bearings. A brake 5 is fixed to the axle 2 next to the rope sheave 3, the brake force of which can be set to be suitable and which includes a brake disc 6. The overspeed governor presented as an example can be regarded as a device with most parts rotating around the axle 2, or as a device in which most of the parts are fitted to rotate around the axle 2.

The rope sheave 3 supports two diametrically opposed axle bolts 14 on the side on which the brake 5 is situated, to which two eccentric cams 15 situated above the brake disc 6 (i.e. outside the diameter of the brake disc) are mounted on a turning bearing, said cams being connected by two curved, essentially symmetrically-shaped centrifugal weights 16. Viewed in the direction of the axle 2 the centrifugal weights together approximately comprise a split circular plate, in the centre part of which is a largish aperture for, among other things, the axle 2 to pass through. Both of the centrifugal weights 16 are mounted at one end on a turning bearing to the eccentric bolts 17 of the one eccentric cam 15 and at the other end to the eccentric bolts 18 of the other eccentric cam.

The rotational direction of the overspeed governor corresponding to the direction of gripping of the elevator and the directions of rotation of the eccentric cams 15 corresponding to the acceleration of the elevator are marked in FIG. 2 with the arrows 101, 102 on the outer rims of the overspeed governor and of the eccentric cams 15.

In an overspeed situation the overspeed governor functions as follows: Switch cams are situated on the outer rim of the centrifugal weights 16, which operate in concert with an electrical switch (not visible in the drawing) fixed to the mounting. This switch is fitted to disconnect the operating current of the motor of the elevator immediately the centrifugal weights 16 protrude after exceeding a certain rotational speed and operate the electrical switch with their switch cams. This rotational speed is lower than the tripping speed for gripping of the elevator. When the set tripping speed is exceeded the eccentric cams 15 turn under the influence of the centrifugal weights 16 so far that their eccentric outer rim connects to the outer rim of the brake disc 6, after which the brake 5 brakes the rope sheave 3 via the eccentric cams 15. The rope sheave 3 also brakes the rope it drives and thus the safety gear of the elevator is tripped.

The overspeed governor can be operated to trip also otherwise than by means of centrifugal force, i.e. by achieving forced tripping with a separate control. For this purpose there are elements in the overspeed governor for connecting the brake 5 to brake the rotation of the rope sheave. When rotation of the rope sheave has been prevented or substantially braked, operation of the safety gears on the elevator car is caused by the movement of the elevator resulting in prevention of the movement of the elevator car. These elements comprise a gear rack 103, which is connected by means of the operating levers 104 to monitor the rotation of the weights 16 and the eccentric cams 15 of the overspeed governor. The configuration of the operating levers and the eccentric cams 15 is arranged such that rotation in the gripping direction causes the turning of the eccentric cams to connect to the brake, if the rotation of the gear rack 103 is suppressed. To suppress the rotation of the gear rack 103 to connect the brake to the elements in order to brake the rotation of the rope sheave an actuator 105 is also included, by means of which the movement of the gear rack 103 is suppressed. The actuator has two basic modes: stopping the gear rack and permitting the movement of the gear rack. When the actuator is controlled to stop the movement of the gear rack, the actuator connects to the gear rack and, when the gear rack has rotated by a certain preset amount after the control for the actuator to stop it, the gear rack stops, whereupon the operating levers hold the eccentric cams, resulting in connection of the eccentric cams to the brake and braking of the rotation of the overspeed governor. When movement of the gear rack is permitted the overspeed governor is able to rotate within the bounds of the set speed range. The actuator 105 contains a lifting lever 106 moveably supported by means of the axle 100, which the operating device 107, e.g. a solenoid, operates. The lifting lever moves the detent lever 108, which is hinged to the lifting lever and on which is a detent pin 109. The mounting 1 contains an aperture 111, via which the detent pin extends to meet the teeth of the gear rack 103. The aperture 111 and its shape can be determined as a cutting made in the mounting or with a separate piece fixed to the mounting, which partly or wholly determines the size and shape of the aperture. The control spring 110 keeps the detent pin from jumping out of the toothing when bringing the detent pin into a recess of the toothing and also prevents the detent pin from rising out of the toothing prematurely. The control spring 110 is fitted to press the detent pin 109 into a recess of the toothing of the gear rack 103 in the area of movement that corresponds to the connection of the eccentric cams to the brake and to lift the detent pin out of the toothing after the connection has occurred. This is achieved by intermatching the shape of the toothing corresponding to the detent pin, the shape of the detent pin and the direction of the supporting force exerted by the spring. The direction of the supporting force of the control spring is influenced on the one hand by the curving of the gear rack, in which the teeth point inwards from the rim, and on the other hand the shape and support of the spring. When using an overspeed governor with pawl action or with the purpose of preventing other than controlled starting of the elevator car the movement of the gear rack is kept within certain limits with the actuator 105. This occurs by lowering the detent pin into the toothing.

When controlling the elevator car to move the detent pin is lifted out of the toothing before the start of the motion or at the beginning of the motion. This function is monitored by means of the sensor 120 or other means that monitors movement of the lifting lever. Control of the operating device 107 is preferably fitted such that an electricity outage or other disruption achieves stopping of the rotation of the gear rack.

It is obvious to the person skilled in the art that the different embodiments of the invention are not limited only to the example described above, but that they may be varied within the scope of the claims presented below. Thus, for example, the gear rack can be constructed such that the toothing is in a direction other than towards the inner part of the rim, e.g. to the side or on the outer edge of the gear rack. In this case of course the structure of the detent is correspondingly different. Another type of gripping instead of the detent function of the toothing can also be considered, e.g. such that instead of the gear rack there is a steel ring or steel plate or similar and the detent pin is replaced with a suitable means e.g. a gripper based on the effect of magnetic force or friction.

It is also obvious to the person skilled in the art that the invention can be applied also in connection with a bi-directional overspeed governor, in which case the toothing is preferably symmetrical and each direction of rotation is provided with its own control spring.

It is obvious to the person skilled in the art that the invention is not limited to the embodiments described above, in which the invention is described using examples, but that many adaptations and different embodiments of the invention are possible within the frameworks of the inventive concept defined by the claims presented below.

The invention claimed is:

1. A method for tripping safety gear of an elevator, at a speed lower than a gripping speed of the elevator, the method comprising:

slowing a rope sheave of an overspeed governor of the elevator using a device adapted to slow the rope sheave;

disconnecting an actuator connected to the overspeed governor from movement of the rope sheave when the device slows the rope sheave; and tripping the safety gear in an overspeed situation using a rope driving the overspeed governor via the rope sheave.

2. The method of claim 1, wherein the tripping of the safety gear occurs when the elevator moves unintentionally.

3. The method of claim 1, wherein the actuator is disconnected using a separate force.

4. An appliance for tripping safety gear of an elevator the appliance comprising:

an overspeed governor;

a rope sheave of the overspeed governor;

a device adapted to slow the rope sheave; and an actuator connected to the overspeed governor that is arranged to disconnect from movement of the rope sheave when the device adapted to slow the rope sheave acts to slow the movement of the rope sheave;

wherein the tripping of the safety gear in an overspeed situation occurs using a rope driving the overspeed governor via the rope sheave, and wherein the tripping of the safety gear occurs at a speed lower than a gripping speed of the elevator.

5. The appliance of claim 4, wherein the actuator remains connected to the movement of the rope sheave for a distance that is specified for the appliance.

6. The method of claim 1, wherein the device adapted to slow the rope sheave is a brake.

7. The method of claim 3, wherein the separate force is provided by a spring.

8. The method of claim 1, wherein the tripping of the safety gear uses a separate control.

9. The appliance of claim 4, wherein the device adapted to slow the rope sheave is a brake.

10. The appliance of claim 4, wherein the overspeed governor comprises:

centrifugal weights;

wherein movement of the centrifugal weights in the overspeed situation causes operating current to a drive motor of the elevator to be cut off.

11. The appliance of claim 4, wherein the overspeed governor comprises:

eccentric cams;

wherein movement of the eccentric cams in the overspeed situation causes the safety gear of the elevator to trip.

12. The appliance of claim 4, wherein the tripping of the safety gear occurs when the elevator moves unintentionally.

13. The appliance of claim 4, wherein the actuator is arranged to disconnect from the movement of the rope sheave using a separate force.

14. The appliance of claim 13, wherein the separate force is provided by a spring.

15. The appliance of claim 4, wherein the tripping of the safety gear uses a separate control.

* * * * *